United States Patent [19]

Takada et al.

[11] Patent Number: 4,707,986

[45] Date of Patent: Nov. 24, 1987

[54] EXHAUST SYSTEM FOR WATER CRAFT ENGINES

[75] Inventors: Toshiyuki Takada, Miki; Noboru Fukui, Kakogawa; Akihito Shimizu, Kobe, all of Japan

[73] Assignee: Kawasaki Jukogyo Kabushiki Kaisha, Japan

[21] Appl. No.: 914,949

[22] Filed: Oct. 3, 1986

[30] Foreign Application Priority Data

Oct. 8, 1985 [JP] Japan ..... 60-224172

[51] Int. Cl.[4] ..... F01N 7/10

[52] U.S. Cl. ..... 60/310; 60/321; 60/323

[58] Field of Search ..... 60/320, 321, 323, 314, 60/310

[56] References Cited

U.S. PATENT DOCUMENTS

| | | | |
|---|---|---|---|
| 3,665,712 | 5/1972 | Tenney | 60/314 |
| 3,875,744 | 4/1975 | Brooks | 60/314 |
| 3,921,398 | 11/1975 | Kashmerick | 60/321 |
| 4,186,819 | 2/1980 | Nowak | 60/314 |

*Primary Examiner*—Douglas Hart

*Attorney, Agent, or Firm*—Eric P. Schellin

[57] ABSTRACT

An improved exhaust system for water craft engines is disclosed, which consists in the main an exhaust manifold connected to the cylinder exhaust port of the engine, an exhaust pipe joined at one end to the exhaust manifold and a diffuser connected at one end to the other end of the exhaust pipe and at the other end to the rest of the exhaust system including a muffler and steam separator. The exhaust pipe is divided into two axial parts, the first vertical, largely U-shaped pipe portion for direct connection to the exhaust pipe at downstream thereof and the second horizontal pipe portion for connection at one end thereof to the first pipe portion at downstream thereof and at the opposite end to the diffuser. The second pipe portion is disposed to extend adjacent to the exhaust manifold and made integral therewith in a rigid assembly, with the first pipe portion being releasably secured to the exhasut manifold and second portion through bolts for easy disassembly in servicing. Thus, since the exhaust pipe is integrally attached to the exhaust manifold through its divided first pipe portion, the entire exhaust system is held in relatively firmly fixed position in the engine compartment of rather limited space, so that operations to secure the various devices of the exhaust system there are greatly eased.

2 Claims, 5 Drawing Figures

EXHAUST SYSTEM FOR WATER CRAFT ENGINES

BACKGROUND OF THE INVENTION

1. Field of the Invention

This invention relates in general to an exhaust system for an engine employed in water craft which is propelled by water jets and, in more particular, to the construction of such a system with rigidity and vibration proofing.

2. Description of the Prior Art

Various types of water craft engines which propels the craft by a jet of water streaming at high velocity from the rear of the engine. In those water craft, the engine, the water jet propulsion system, the air intake device and the exhaust system are put together in a compartment of rather limited space.

FIG. 5 illustrates the typical structure of a representative water craft engine in the prior art such as disclosed in laid-open Japanese utility model application No. 57-32249. The construction shown is a compromise between the positional relationship of the exhaust system to the engine and particularly its output shaft, the required incorporation of a diffuser, muffler and steam separator, and the balance of weight of the entire equipment.

Referring to the same drawing, the engine 1 has its output shaft 2 connected to the water jet propulsion system, not shown, on the opposite side to the exhaust system, which in turn comprises the exhaust manifold 3, exhaust pipe 4, diffuser 5, muffler 6, steam separator 7, and tail pipe 8, all connected in sequence. The exhaust system is structured such that the exhaust gas from the engine 1, after leaving the exhaust manifold 3, is conducted to turn sharply by the vertically supported exhaust pipe 4 and enter the diffuser 5 following the opposite direction to its initial flow.

In the engine compartments of those water craft, the engines, together with their exhaust systems, are generally secured in position to the floor and hull walls, with the intermediacy of elastic vibration-proof pads or mats to prevent transmission of the engine vibrations to the craft body.

However, in the past, complicated work with considerable difficulties have had to be involved in disposing the engine and its associated devices within their usually narrow compartment in such a layout that insure their normal function. Moreover, the narrowness of the space in itself have impeded securing them in positions to the compartment floor or wall.

For example, since the entire exhaust setup leading to the tail pipe 8 is connected to the engine 1 through the exhaust manifold 3 alone, the rest of the system between them including the exhaust pipe 4, diffuser 5, muffler 6, and steam separator 7 have to be rigidly secured in positions in the compartment to prevent transmission of engine vibrations to the other sections of the water craft. Furthermore, they must be connected to one another without looseness in the joints to prevent leakage of exhaust gases. In addition, since the water craft is operated in the waters, these devices must be housed in watertight condition. These requirements have demanded complicated work and, in an extreme case, have barely been met with great difficulties.

Moreover, since an exhaust system in operation emits very high temperatures, special provision has to be made to secure it in position. This has posed some difficulty with those prior art exhaust systems.

SUMMARY OF THE INVENTION

The present invention has been proposed to eliminate the above-mentioned problems.

It is therefore a primary object to provide the construction of an exhaust system with rigidity and vibration proofing.

The above and other objects, features and advantages of the present invention are accomplished by an improved construction of exhaust system which may be summarized as follows:

1. The exhaust pipe, which is interconnected between the exhaust manifold and the diffuser, is divided into two axial parts, the first vertical, largely U-shaped portion and the second horizontal portion mounted extending adjacent to the exhaust manifold and connected downstream of the first portion which in turn connected directly to the exhaust manifold.

2. The exhaust manifold, which is directly connected to the cylinder exhaust port, is made bodily integral with the second portion through their opposed outside surfaces.

3. The first portion is releasably secured through one end thereof to the exhaust manifold and through the other end to the second portion of the exhaust pipe.

4. The second portion of the exhaust pipe is connected through its opposite end to the rest of the exhaust system via the diffuser.

Since the second portion of the exhaust system is made physically integral with the exhaust manifold, which is in turn secured fixedly to the engine, with the first portion being fixed between the rigidly joined first portion and manifold, such that the whole exhaust pipe is held in sufficiently locked position, without the need of securing it to the compartment floor or walls.

Furthermore, since the diffuser is connected to the firmly fixed second portion of the exhaust pipe, the connection of the rest of the exhaust system to the engine is reinforced as a whole.

DETAILED DESCRIPTION OF PREFERRED EMBODIMENTS

Figure 1:
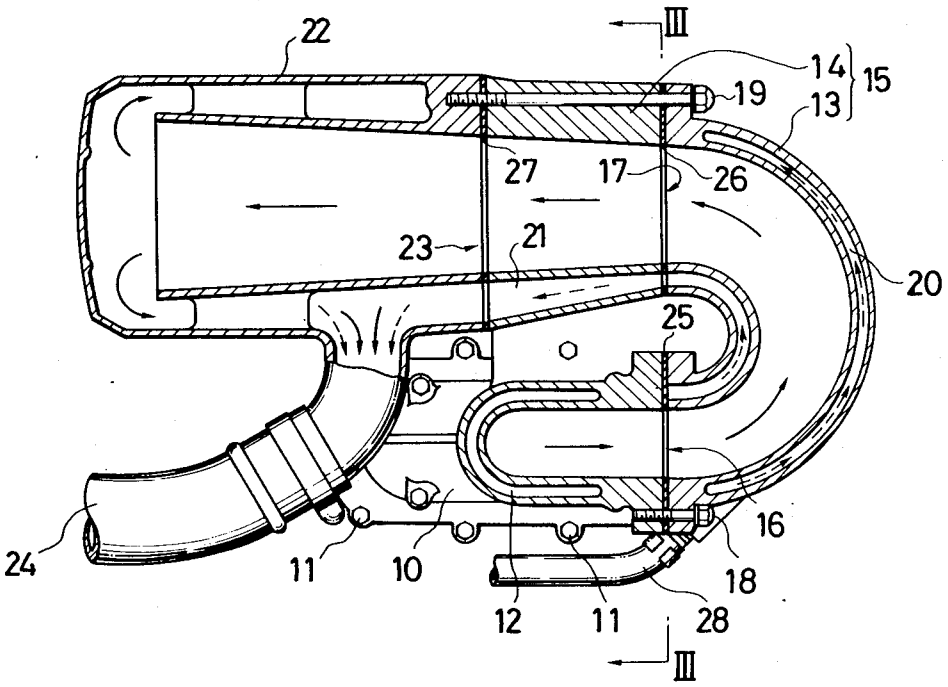
FIG. 1 is a front sectional view of the important part of the exhaust system for water craft engines according to the present invention.
Figure 2:
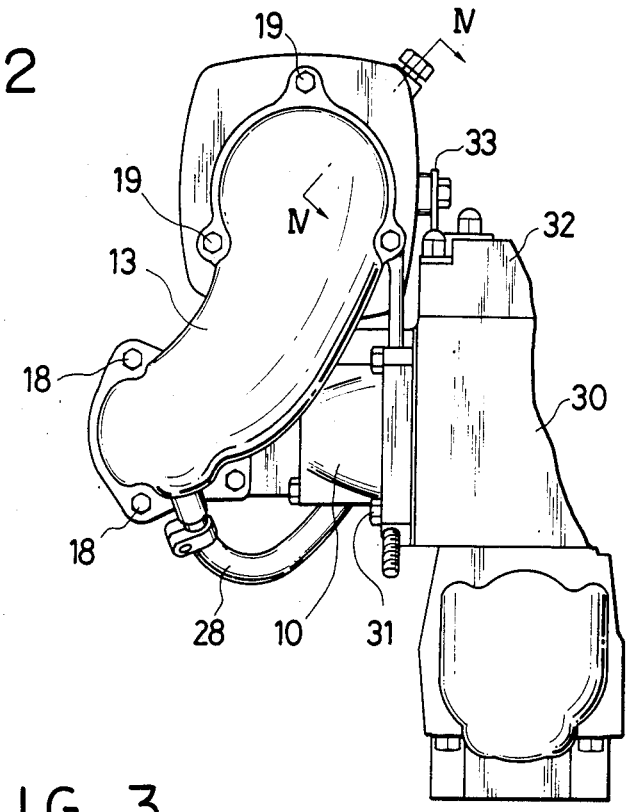
FIG. 2 is a side view of the exhaust system depicted in FIG. 1.

Referring first FIGS. 1 and 2, an exhaust system is depicted, which comprises an exhaust manifold 10 secured at one end thereof to the exhaust port of a cylinder 30 through bolts 11, a liquid cooling jacket adapted to enclose the exhaust manifold 10 for cooling and connected to a cooling jacket for the cylinder, and an exhaust pipe 15 connected at one end thereof to the other end of the exhaust manifold 10.

The exhaust pipe 15 is divided into a vertical, largely U-shaped first portion 13 for direct connection to the exhaust manifold 10 and a second horizontal portion 14 connected downstream of the first portion 13 and mounted to extend adjacent to the exhaust manifold 10, as depicted in FIG. 1.

The second horizontal portion 14 is made integral with the external surface of the exhaust manifold 10 in such a manner to hold the former in rigidly fixed position. The exhaust manifold 10 is secured at its one end 16 to one end of the first portion 13 through bolts 18. The other end of the first portion 13 is secured to the opposed end 17 of the second horizontal portion 14 through bolts 19. In this particular embodiment, although the connected end 16 of the exhaust manifold 10 is made coplanar with the end 17 of the second horizontal portion 14, this is only a matter of choice and they may be constructed otherwise.

The first portion 13 is enclosed in a cooling jacket 20 for cooling. Also, the second horizontal portion 14 is encased in a second cooling jacket 21 for cooling. A diffuser 22 is secured to the opposite end 23 of the second horizontal portion 14 with the same bolts 19 used to attach the first portion 13 to the second horizontal portion 14 of the exhaust pipe 15.

An exhaust tail tube 24 is provided to connect the diffuser 22 to the rest of the exhaust system including a muffler and steam separator, both now shown.

A first gasket 25 is provided installed between the end 16 of the exhaust manifold 10 and the first portion 13 to seal their joint. The first gasket 25 is mounted in such a manner to prevent cooling water communication between the neighboring cooling jackets 12 and 20. Also, a second gasket 26 is provided to seal the joint between the first portion 13 and the end 17 of the second horizontal portion 14. However, the cooling jacket 20 is in cooling water communication with the second cooling jacket 21.

A third gasket 27 is installed to seal the joint between the second horizontal portion 14 and diffuser 22. The second cooling jacket 21 for cooling the second portion 14 is in part communication. A cooling pipe 28 is provided interconnected between the cooling jacket 20 and cylinder cooling jacket 12 to supply cooling liquid from the latter 12, after cooling the cylinder, to the cooling jacket 20.

The exhaust gases from the cylinder 30 are conducted through the exhaust system following the direction of the arrows depicted in solid line in FIG. 1. The cooling liquid from the cylinder cooling jacket 12 is allowed to flow through the cooling jackets 20 and 21 in the direction of the arrows depicted in broken line in the same drawing to blend with the flow of the exhaust gases at the inlet end of the exhaust tail tube 24 which in turn discharges the mixture from the diffuser to the muffler, not shown.

The exhaust manifold 10 is secured to the cylinder 30 through bolts 31 and fixed to the cylinder head 32 through a bracket 33, as shown in FIG. 2.

Figure 3:
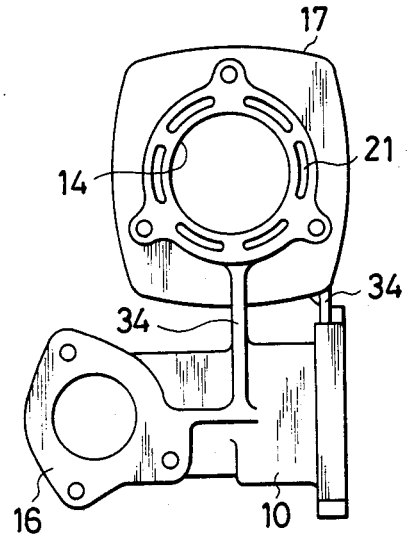
FIG. 3 is a side sectional view taken along the line III—III of FIG. 1.

Referring to FIG. 3, the exhaust manifold 10 may be made integral with the second horizontal portion 14 of the exhaust pipe 15 through a connector member 34.

Figure 4:
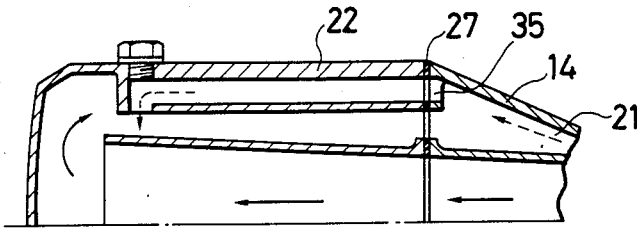
FIG. 4 is an enlarged sectional view taken along the line IV—IV of FIG. 2.
Figure 5:
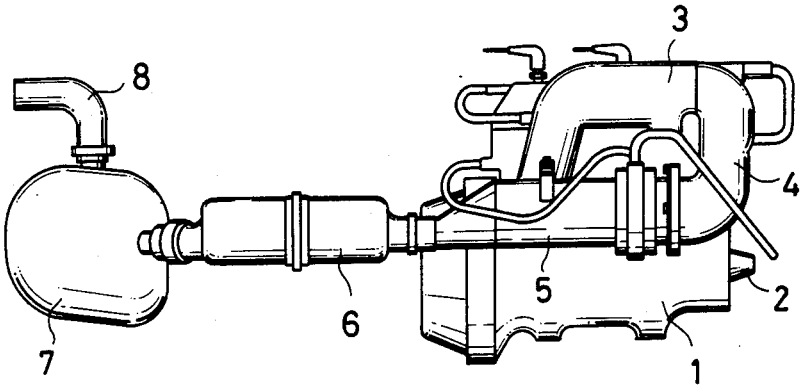
FIG. 5 PRIOR ART
FIG. 5 is a side view of the conventional exhaust system.

Referring to FIG. 4, the cooling liquid from the second cooling jacket 21 is allowed to enter the diffuser 22 through a hole 35 bored in the third gasket 27 and further flow in the direction of the arrow depicted in broken line in the drawing to blend with the exhaust gases, which flow in the direction of the arrows depicted in solid line, after they have been reduced in pressure before the mixture is discharged through the exhaust tail tube 24.

It will be appreciated from the above that the exhaust pipe is secured rigidly in position by having its divided portion made integral with the exhaust manifold. This arrangement also contributes to securing the entire exhaust system in fixed position. Since the first portion is bolted to the exhaust manifold, there is no problem in servicing and inspection.

Thus, the exhaust system according to the present invention can easily be assembled in engine compartments of limited space as in water craft, with reduced effort to secure the assembly in position.

Furthermore, since the second portion of the exhaust pipe is located near the exhaust manifold, a short connector pipe can be used to conduct the cooling liquid from the cylinder cooling jacket to the cooling jacket for the exhaust pipe, with resultant exhaust efficiency.

In addition, the portion of the system from the exhaust manifold to the diffuser can be build in a compact design so that the entire exhaust system can be made lightweight.

What is claimed is:

1. In an exhaust system for water craft engines, said exhaust system consisting of an exhaust manifold connected to the cylinder exhaust port of the engine, an exhaust pipe connected at one end thereof to said exhaust manifold, and a diffuser connected to the opposite end of said exhaust pipe, the improvement wherein said exhaust pipe is divided into a first vertical, largely U-shaped pipe portion immediately connected at one end thereof to said exhaust manifold and a second horizontal pipe portion connected at one end thereof to the opposite end of said first pipe portion at downstream thereof and at the other end to said diffuser, said second pipe portion being mounted to extend adjacent to said exhaust manifold and made integral with the opposed external surface of said exhaust manifold.

2. An exhaust system as set forth in claim 1, wherein said exhaust manifold and exhaust pipe are each constructed in a double structure to provide separate passages for cooling liquid and exhaust gases from the engine, respectively.

* * * * *